United States Patent [19]

Aoki et al.

[11] 4,141,793

[45] Feb. 27, 1979

[54] PROCESS FOR PREPARATION OF COKE AND CARBONIZER THEREFOR

[75] Inventors: Yutaka Aoki, Tokyo; Akira Hase, Kawasaki; Jiro Ito, Kamakura; Hisomu Nagai, Tokyo, all of Japan

[73] Assignee: Nissho-Iwai Co., Ltd., Tokyo, Japan

[21] Appl. No.: 743,703

[22] Filed: Nov. 22, 1976

[30] Foreign Application Priority Data

Nov. 28, 1975 [JP] Japan ..... 50-141579

[51] Int. Cl.[2] ..... C10B 1/10; C10B 49/06; C10B 53/08

[52] U.S. Cl. ..... 201/6; 110/247; 110/275; 201/24; 201/32; 201/36; 202/100; 202/117; 202/136; 202/216; 432/14; 432/138

[58] Field of Search ..... 201/5, 6, 24, 32, 36, 201/33, 40; 202/100, 117, 136, 216, 218; 432/138, 124 US, 23, 72, 139; 110/13, 36, 247, 275

[56] References Cited

U.S. PATENT DOCUMENTS

| | | | |
|---|---|---|---|
| 653,819 | 7/1900 | Regout | 432/138 X |
| 1,557,320 | 10/1925 | O'Donnell | 201/24 X |
| 1,667,906 | 5/1928 | Strafford | 201/6 |
| 2,112,401 | 3/1938 | Hardy et al. | 202/136 |
| 2,533,492 | 12/1950 | Mekler | 202/117 |
| 2,955,991 | 10/1960 | Tufty | 202/117 |
| 3,010,882 | 11/1961 | Barclay et al. | 201/6 UX |
| 3,541,603 | 11/1970 | Tsujihata et al. | 202/117 X |
| 3,560,369 | 2/1971 | Rowland et al. | 201/6 X |

*Primary Examiner*—Joseph Scovronek

*Attorney, Agent, or Firm*—Stevens, Davis, Miller & Mosher

[57] ABSTRACT

A horizontal circulating carbonizer comprising an annular horizontally rotatable circulating hearth disposed rotatably, a carbonizer body covering said hearth, a coal feeder equipped on the carbonizer body, a preheating zone disposed in the vicinity of said feed coal supply opening, a carbonizing zone connected to said preheating zone, a cooling zone connected to the carbonizing zone, and a discharger of cooled coke, and a process for the preparation of coke using this horizontal circulating carbonizer.

9 Claims, 3 Drawing Figures

PROCESS FOR PREPARATION OF COKE AND CARBONIZER THEREFOR

BACKGROUND OF THE INVENTION (a) Field of the Invention

Steel is the most important metallic material, and the demand for steel has increased remarkably in recent years. It has been possible to meet this increasing demand for steel only by rapid progress and development in pig iron-manufacturing and steel-manufacturing techniques. One area of progress has been finding solutions to the problem of improving the quality of metallurgical coke to be used for blast furnaces and of developing methods for the mass-production of such coke.

Coke for use in blast furnaces is required to have the following properties:

(1) The strength expressed as the 15 mm index in the drum test (wherein the coke is rotated 30 times in a drum under conditions specified in JIS K2151 and the 15 mm index $DI_{15}^{30}$, namely the proportion (%) of coke particles having a size not smaller than 15 mm after the test, is determined) must be 90 to 95.

(2) The particle size of coke must be relatively uniform in the range of from about 25 to about 75 mm.

(3) The ash content must be as low as about 10 to about 11%.

(4) The sulfur content muxt be low, not exceeding 0.8%.

(5) The porosity must be in the range of from 40 to 60%.

(6) The reactivity index as determined according to JIS K2151 must be in the range of from 15 to 25.

By using coke meeting the foregoing requirements, the blast furnace operation can be performed stably at high efficiency.

Coke meeting the above requirements has heretofore been prepared from a mixture of hard coking coal and soft coking coal mainly because use of these feed coals gives the strength necessary for stable blast furnace operation. Although hard coking coal has been indispensable for production of blast furnace coke, the world's supply of hard coking coal is low and coke makers are finding it difficult to secure a necessary quantity of hard coking coal.

It is therefore anticipated that with increase of iron and steel production, it will be even more difficult to secure the necessary quantity of hard coking coal and the price thereof will inevitably increase rapidly.

This problem is very serious in the field of steel manufacture and some solution is strongly desired. Namely, development of a process for production of blast furnace coke in which hard coking coal need not be used at all or in which the amount of hard coking coal used is drastically reduced is desired in the art. Coke prepared according to the present invention meets this need.

Another problem to be solved in the production of coke is the problem of environmental pollution. It is often said that the main cause of environmental pollution in the iron industry is the coking plant, and various complaints are heard concerning the chamber-type coking oven. All the operations from charging of feed coal to withdrawal of produced coke are performed in the open state and sufficient measures are not being taken to prevent discharge of coal particles, dusts, gases, tar and nitrogen oxides. Of course, adoption of a closed system has heretofore been attempted in the art, but none of the attempts has substantially overcome the problems of the existing coking oven of the chamber type. Moreover, when the coking operation is carried out in the chamber-type coking oven, various steps must be conducted manually and the process cannot be worked in a continuous manner. Therefore, it is impossible to perform the coking process automatically while attaining a labor-saving effect.

When the carbonizer of the present invention is used, all the steps can be performed in a closed system and automation of the coking process becomes possible. In short, the present invention successfully overcomes all the defects and disadvantages involved in known carbonizers of the chamber type.

(b) Description of the Prior Art

Known carbonizers are roughly divided into two types: namely the type in which by-products are not recovered and the type in which by-products are recovered. The beehive coke oven can be mentioned as a typical instance of the former type, and typical instances of the latter type include (1) a horizontal flue type, e.g., the Solvay furnace and (2) a vertical flue type, e.g., the Koppers and Otto furnaces. Each of these known carbonizers involves various defects such as pointed out in (a) above.

Although formed coke has not yet been manufactured on an industrial scale, it can be obtained by the following steps.

Non-coking coal pulverized to have a prescribed particle size is incorporated into feed coal at an appropriate ratio. This mixing ratio is determined on the basis of such factors of the feed coal as ash content, volatile content, sulfur content, coking property fluidity and swelling property. Then, a binder such as pitch or bitumen is added to the resulting coal blend and the blend is kneaded at a temperature sufficient to melt the binder. The kneaded blend is briquetted under compression to obtain briquette coal. This briquette coal is charged in a high temperature carbonizer to effect coking and obtain formed coal.

The process for preparing formed coke can be roughly divided into two steps, namely the briquetting step and the carbonizing step.

The molding step involves various problems still unsolved, but if the feed coal and briquetting method are appropriately chosen, mass production is possible to some extent. A suitable oven or furnace for performing the latter carbonizing step has not yet been developed.

Shaft furnaces, travelling grate furnaces, rotary kilns or chamber furnace type coking ovens have heretofore been used as carbonizers for performing the carbonizing step, and among them, shaft furnaces are most promising and test plants have already been constructed. When a furnace of this type is employed, a product is prepared while briquette coal is allowed to fall in the furnace by its own weight, and the process seems advantageous. However, although briquette coal falls smoothly in case of a small-scale pilot plant, in case of a large plant, it is difficult to achieve uniform heating so that agglomeration of briquette coal particles (a kind of the sintering phenomenon) results. Consequently, such troubles as hanging occur and a product having a good quality cannot be obtained.

Travelling grate furnaces are now used in plants for sintering and pelletizing iron ores, and some good results have been attained. However, when a furnace of this type is employed, a perfect seal cannot be attained. More specifically, since a belt conveyor disposed in the furnace includes parts moving upwardly and downwardly (at both the ends), no complete seal can be attained at these moving parts. When the furnace is used for sintering or pelletizing iron ore according to the known techniques, the operation is carried out while sucking air and therefore no particular disadvantage is brought about even if complete seal is not attained. However, this fact results in a fatal defect when the furnace is used for carbonizing coal. More specifically, generation of poisonous gases cannot be obviated in carbonization of coals so that environmental pollution occurs. Therefore, when a travelling grate furnace is employed, the entire plant must be contained in a closed chamber.

Rotary kilns cannot be adopted because formed coal or coke is broken by rotation.

Since chamber furnace-type coking ovens heretofore used are of the external heating type, the width is very narrow but the length is long (width = about 50 to about 40 cm, length = about 15 m, height = about 5 to about 7 m). When such an oven is used, although carbonization can be performed without any particular problems, it is difficult to withdrawn the carbonization product, i.e., coke. More specifically, although discharge can be accomplished conveniently by extrusion in case of coke having a high strength ($DI_{15}^{30}$ value of at least 85) which is prepared from feed coal containing hard coking coal, as is well known in the art, in case of coke insufficient in the strength prepared from non-coking coal or weakly coking coal, discharge of the product cannot be performed conveniently by extrusion or the like because of clogging.

In order for coke to be discharged smoothly from a narrow and long furnace such as the chamber furnace type coking oven, it is necessary for the coke to have a sufficient strength as pointed out above and in addition, the coke should form one rigid body. When the coke forms one rigid body, if a small force is applied at one end of the furnace, the coke can easily be discharged from the other end. However, if the coke is present not in the form of one rigid body but in the disintegrated fragmentary state, even when a force is applied at one end of the furnace, the effect is only to close up voids or clearances and the coke cannot be discharged or withdrawn. If a larger force is applied, the refractory bricks of the furnace will be broken. In case of formed coke, the strength is sufficient to perform withdrawal by extrusion but respective particles are present independently and they do not form one rigid body. Therefore, the formed coke cannot be discharged by extrusion because of clogging.

In addition, there can be mentioned a bottom open hearth-type furnace in which the product is withdrawn by opening the furnace hearth. However, a large furnace of this type cannot be expected to be practical. The maximum capacity among existing furnaces of this type is about 3 tons.

As will be apparent from the foregoing illustration, there has not yet been developed a coking furnace capable of mass production of formed coke.

As a result of various experiments and investigations, we have now succeeded in developing a horizontal circulating carbonizer which is quite different from known carbonizers in structure and function and a process for the preparation of formed coke using this novel carbonizer.

SUMMARY OF THE INVENTION

In accordance with the present invention, there is provided a horizontal circulating carbonizer for the preparation of coke which comprises a horizontal circulating annular hearth disposed rotatably in the horizontal direction, a stationary circulating horizontal carbonizer body covering said hearth, an opening formed on the carbonizer body to feed briquette coal or non-briquette coal, a preheating zone disposed in the vicinity of the coal feed opening, a carbonizing zone connected to said preheating zone, a cooling zone connected to said carbonizing zone and an opening for withdrawal of cooled formed or non-formed coke.

In accordance with the present invention, there is also provided a process for the preparation of coke which comprises feeding briquette or non-briquette coal composed of at least one feed coal material selected from non-coking coal and coking coal to a horizontal circulating annular hearth in the closed and sealed state, moving the feed coal on an annular plane in the horizontal direction, preheating it at a low temperature, heating it at a high temperature to effect carbonization and continuously discharging formed or non-formed coke from the hearth.

DESCRIPTION OF THE PREFERRED EMBODIMENTS

The present invention relates to a horizontal circulating carbonizer comprising a stationary horizontal circulating carbonizer body of a specific configuration including a carbonizing annular plane moving in the horizontal direction, in which non-formed or formed coke can be prepared continuously at high efficiency.

The term "coke" used in the instant specification means not only non-formed coke but also formed coke.

The horizontal circulating carbonizing furnace of the present invention for production of coke comprises a preheating zone, a carbonizing zone and a cooling zone as main constituent zones.

The carbonizing furnace of the present invention will now be described in detail with reference to the accompanying drawing.

Figure 1:
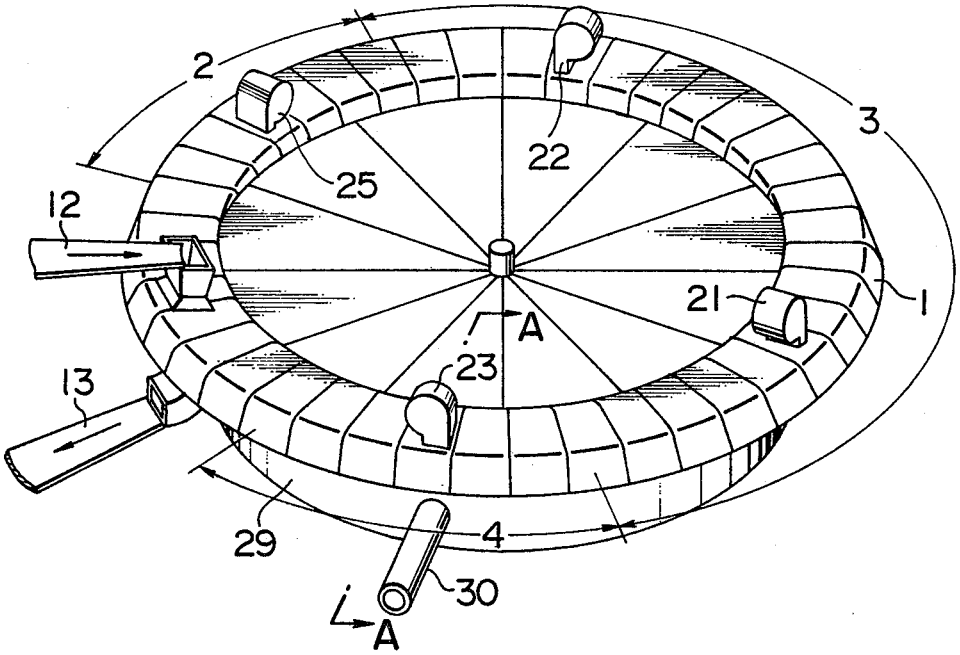
FIG. 1 is a perspective view of the horizontal circulating carbonizer according to the present invention.

FIG. 1 illustrates the horizontal circulating furnace for the preparation of coke according to the present invention. This furnace comprises in the interior thereof an annular hearth rotating in the horizontal direction.

A coal supply feeder opening 12 is formed on the furnace, and a preheating zone 2 is disposed in the vicinity of the supply feeder 12, and this preheating zone 2 is connected to the carbonizing zone 3 which is then connected to a cooling zone 4. A coke discharger opening 13 is disposed downstream of the cooling zone 4. The coal supply feeder 12 is located at a position adjacent to the position of the coke discharger 13.

The hearth of the carbonizer of the present invention has an annular shape and is circulated only in the horizontal direction. In other words, the carbonizer of the present invention includes no parts moving in the vertical direction as seen in the conventional travelling grate furnace. Accordingly, complete seal can be attained. In preferred embodiments of the invention, the hearth is a latticed structure composed of a special heat-resistant steel or a latticed structure composed of refractory bricks and/or a heat resistant alloy.

Further, since a mechanism for forcibly circulating the hearth is adopted, even is sintering or the like takes place in the carbonizer body, stagnation is not caused at all.

One cycle of the operation of the annular horizontal circulating carbonizer is about 1 to about 7 hours, preferably 2.5 to 5.5 hours. More specifically, preheating is conducted for about 10 to about 70 minutes, preferably 25 to 55 minutes, the carbonization is conducted for about 25 to about 175 minutes, preferably 70 to 130 minutes, and the cooling is conducted for about 25 to about 175 minutes, preferably 70 to 130 minutes.

In the drawing, feed coal is fed into the preheating zone 2 from the supply feeder 12. When non-briquette coke is prepared, non-coking coal or weak coking coal is used as the feed coal.

When formed coke is produced the feed coal is pulverized to have a prescribed particle size and an adjusted particle size distribution, and a binder or coking coal is mixed with the pulverized feed coal. Then, the resulting mixture is briquetted.

When formed coke is produced, in general, coking coal or hard coking coal is not used but non-coking coal or soft coking coal is employed. A mixture of non-coking coal and soft coking coal can also be used.

In the instant specification, the term "feed coal" is used to include both of the above-mentioned two types of starting coal materials.

When formed coke is produced from feed coal having a high volatile content, it is preferred to perform briquetting after removal of volatile components or conduct preliminary carbonization after briquetting and to charge the feed coal to the carbonizer after such pretreatment. The reason for this is that formed coke is broken if volatile components are removed therefrom during carbonization.

Feed coal is then moved to the carbonizing zone and heated at 800 to 1100° C., preferably about 1000° C., and it is carbonized and coked. Simultaneously, tar and gas are generated as by-products.

The resulting coke or formed coke is passed through the cooling zone 4 and continuously discharged from the discharger 13.

Figure 2:
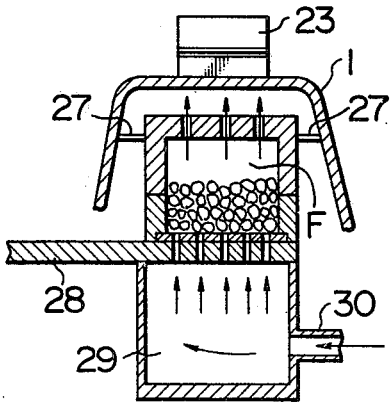
FIG. 2 is a view showing the section taken along the line A—A in FIG. 1.

FIG. 2 is a view illustrating the section of the annular horizontal circulating carbonizer of the present invention. As is seen from FIG. 2, the carbonizer comprises a hearth (rotary disc) 28 rotating horizontally, a stationary carbonizer body F, water-sealing or other sealing means 27, a stationary cover 1 and a stationary gas supply chamber 29 disposed close to the lower portion of the hearth.

In the present invention, the heating medium gas maintained at about 1000° C. is introduced into the gas supply chamber 29 through a gas conduit 30, and it is then introduced into the carbonizer body F through a great number of holes formed on the hearth 28. This heating medium gas provides the charged briquette coal or non-briquette coal with heat to effect carbonization.

The tar and gas generated in the carbonizer body F are combined with the heating medium gas and the resulting gaseous mixture rises from the top portion of the carbonizer body and is discharged through another gas conduit (not shown).

Figure 3:
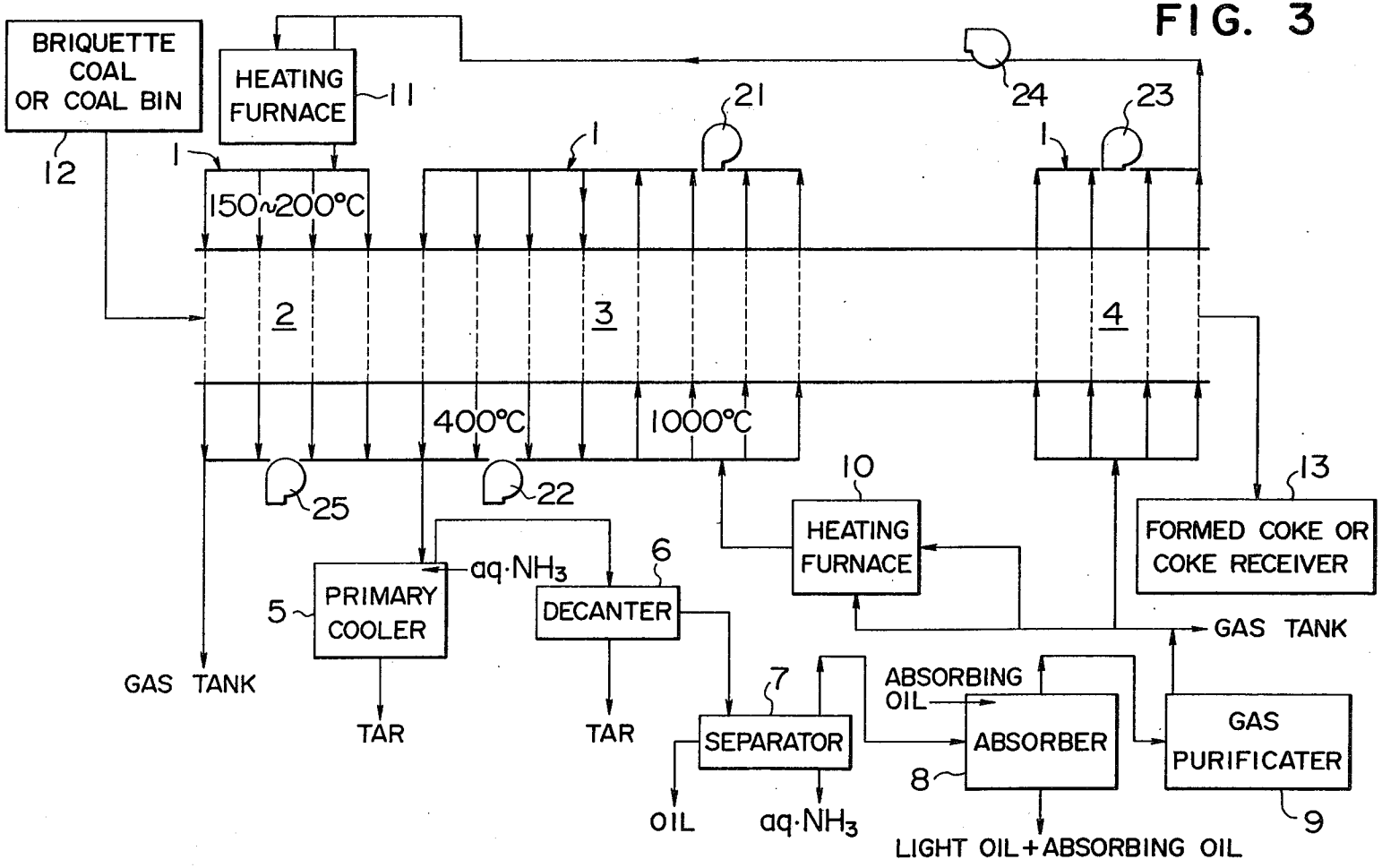
FIG. 3 is a flow chart functionally illustrating the flows of the feed coal, product, heat medium gas for carbonization, and coal gas and tar formed by carbonization.

FIG. 3 is a flow chart illustrating the flows of feed coal, produced coke and by-products such as gas and tar. As will be apparent from FIG. 3, the feed coal is passed through the coal feeder 12, the preheating zone 2, the carbonizing zone 3 and the cooling zone 4 and the product is discharged from the discharger 13.

In FIG. 3, reference numeral 10 represents a heating furnace of the external heating type to supply heat necessary for carbonization. Coal gas generated at the carbonizing step is used as the heating medium gas for carbonization. This heating medium gas is heated to 900 to 1200° C., preferably about 1100° C., and it is then introduced into one end of the carbonizing zone 3. The heating medium gas may be introduced to one end of the carbonizing zone 3 which is remote from the cooling zone 4 and may be discharged from the other end near the cooling zone. However, it is preferred that the heating medium gas be introduced to the end near the cooling zone 4 and discharged from the other end remote from the cooling zone, because a counter-current contact is attained between the feed coal and the heating medium gas.

Coal gas generated at the carbonizing step is also used as the fuel for the carbonizing heating furnace 10.

The heating medium gas is sucked from the bottom of the carbonizing zone 3 through a layer of briquette coal or non-briquette coal to the upper portion by a sucking device 21, and it is then sucked into the adjacent lower portion by a sucking device 22. More specifically, while the heating medium gas is caused to rise by the upper sucking device 21 and is brought down by the lower sucking device 22, the feed coal is heated to 1100 to 400° C. and carbonized. Thus, coking is completed. Simultaneously, tar and gas are formed as by-products.

The so-formed gas and tar are combined with the heating medium gas from the carbonizing heating furnace and the mixture is discharged from the terminal end of the carbonizing zone while it is maintained at about 400° C. (sufficient to prevent tar from solidification). Then, the discharged mixture is introduced into a primary cooling column 5 where the gaseous mixture is cooled with ammonia liquor to thereby remove tar and the like. Then, the gas is passed through a decanter 6 and an ammonia liquor separator 7 to separate it into gas, oil and ammonia liquor. The resulting gas is then passed through an absorbing column 8 to remove light oil therefrom and is then introduced into a gas refining apparatus 9. Thus, so-called clean coal gas is recovered, and a part of the clean coal gas is stored in a tank and is used for various purposes.

Formed coke or non-formed coke thus produced is cooled in the cooling zone 4. The coal gas generated is used as the cooling medium. While the gas is fed from the lower portion to the upper portion by a sucking device 23, the formed coke or non-formed coke is cooled to 60 to 200° C.

The gas which has passed through the cooling zone is then fed to a preheating furnace by a sucking device 24.

This preheating furnace 11 is of the external heating type like the heating furnace 10, and the gas which has passed through the cooling zone is used as the heating medium for this preheating furnace 11. The gas having its temperature raised to about 300° C. in the preheating furnace is moved from the upper portion to the lower portion by a sucking device 25 to preheat the carbonizing furnace to about 150 to about 200° C. and it is then fed to the gas tank.

In the present invention, an internal heating system (using gas generated by carbonization as a heating medium) is adopted, and the gas generated by carbonization is used for preventing lowering of the heat quantity. If reduction of the heat quantity of the gas generated is of no significance, it is advantageous to use combustion gas as the heating medium. However, since the combustion gas contains oxygen and oxygen compounds, i.e., $CO_2$, CO and $O_2$, in large quantities, exposure of formed coke to the combustion gas results in degradation of the quality of formed coke. More specifically, the strength is reduced and the reactivity is enhanced, and therefore, the product is not preferred as blast furnace coke.

Accordingly, it is preferred except in special cases to adopt a system using gas generated by carbonization as the heating medium.

It has been found that the quality of formed coke prepared according to the present invention is comparable to the quality of conventional blast furnace coke.

The carbonization process of the present invention can be applied to carbonization of various kinds of coals. When coking coal alone is used, it is caked and obstructs the flow of air or gas. Accordingly, coking coal must be used in the form of a mixture with non-coking coal. Non-coking coal and weak coking coal such as anthracite and brown coal can be conveniently used for production of coke without any trouble.

The present invention will now be described with reference to the following Example that should by no means be construed as limiting the scope of the invention.

EXAMPLE

(Production of Formed Coke)

A mixture comprising 20% of anthracite (having a volatile content of 8%), 44% of semi-anthracite coal (having a volatile content of 15%), 20% of soft coking coal (having a volatile content of 40%), 10% of coking coal (having a volatile content of 22%) and 6% of a binder (having a softening point of 80° C.) was pulverized, heated and kneaded with steam and briquetted by a briquetting machine. According to the carbonizing process shown in the flow chart of FIG. 3, carbonization was carried out at 1000° C. for 1 hour. The quality of the obtained product was as shown below:

| Item | Formed Coke |
|---|---|
| Size (mm) | 40 × 40 × 40 |
| Ash content (%) | 10.2 |
| Volatile content (%) | 1.27 |
| Sulfur content (%) | 0.65 |
| Apparent density | 1.16 |
| Specific gravity | 1.94 |
| Porosity (%) | 40.0 |
| Strength ($DI_{15}^{30}$) (JIS K-2151, 1960) | 95.0 |
| Reactivity (JIS K-2151, 1960) | 25.0 |

As will be apparent from the above results, the coke prepared according to the present invention is comparable to conventional blast furnace coke.

Effects attained by the present invention are as follows:

(1) The carbonizer of the present invention is of the closed system and cause no environmental pollution at all.

(2) The carbonization operation can be performed continuously, and automation is possible and a labor-saving effect can be attained.

(3) The quality of the obtained formed coke product is very good. The strength is especially excellent.

(4) The carbonizer of the present invention has a simple structure, and hence, the scale can be easily be enlarged.

(5) Non-coking coal and weak coking coal can be used as the starting coal material for production of blast furnace coke.

What is claimed is:

1. A forced-draft, horizontal circulating annular carbonizer for the preparation of coke comprising (a) an annular hearth rotating in the horizontal direction and having a lower portion, (b) a stationary annular horizontal carbonizer body covering said hearth, said carbonizer body including (1) a coal feeder, (2) a coke discharger disposed in the vicinity of said coal feeder, (3) a preheating zone having a preheating means for preheating coal and/or briquette coal maintained at a temperature of about 150° to about 200° C. with the gas passed through the cooling zone-and heated up by heat exchange with hot coke and through a heating furnace, (4) a carbonizing zone having carbonizing means for carbonizing preheated coal or briquette coal into coke maintained at a temperature of about 800° to about 1100° C. with the gas endowed by sensible heat by an external heating furnace, and (5) a cooling zone having means for cooling down hot coke or formed coke maintained at a temperature of about 60° to about 200° C. with the gas that is generated during carbonization and cooled down to an ambient temperature through a primary cooler, decanter, separator, absorber, and gas purificator, (c) a cover for keeping said carbonizer body in the sealed and closed state under a reducing atmosphere, (d) a gas supply chamber for introducing and distributing the gas into the respective zones for preheating, carbonizing coal, and cooling coke, disposed close to the lower portion of said annular hearth, and (e) a system comprising means for recycling (i) a part of the gas generated during carbonization of coal and/or briquette coal, after providing sensible heat by the external heating furnace in (b) (4), to said carbonizing zone for carbonizing coal or briquette coal and (ii) a part of the gas to said cooling zone for cooling down the hot coke or formed coke through the primary cooler, decanter, separator, absorber, and gas purificator, and means for discharging the remainder gas from the carbonizer.

2. A horizontal circulating annular carbonizer as set forth in claim 1 wherein a hearth of a latticed structure composed of a heat-resistant steel is used as the annular hearth.

3. A horizontal circulating annular carbonizer as set forth in claim 1 wherein a hearth of a latticed structure composed of refractory bricks and/or heat resistant alloy is used as the annular hearth.

4. The force-draft horizontal circulating annular carbonizer of claim 1 having a gas supply chamber disposed close to the lower portion of said annular hearth.

5. A process for the preparation of coke which comprises supplying feed coal to an annular horizontal carbonizer body that includes an annular hearth moving in the horizontal direction below said body and is kept in the sealed and closed state, heating said feed coal at a temperature between about 150° and about 200° C. in a preheating zone of said carbonizer body using gas taken from the cooling zone referred to hereinafter and heated by an external furnace to a temperature sufficient to heat said feed coal in said preheating zone at a temperature between about 150° and about 200° C., heating the preheated coal with a portion of the gas which is taken from the carbonizing zone, cooled, and reheated in an external heating furnace, at a temperature of about 800° to about 1100° C. in a carbonizing zone of said carbonizer body to effect carbonization and coking, cooling the resulting coke, in a cooling zone of said carbonizer body, with another portion of the gas generated during carbonization and cooled down to an ambient temperature, and discharging the resulting coke from a coke discharger.

6. A process for the production of coke according to claim 5 wherein the feed coal is briquette coal obtained by pulverizing at least one kind of coal selected from the group consisting of non-coking coal and coking coal, to have a prescribed particle size and briquetting the pulverized coal with binder.

7. A process for the production of coke according to claim 5 wherein the feed coal is briquette coal obtained by pulverizing at least one kind of coal selected from the group consisting of non-coking coal and coking coal, to have a prescribed particle size and briquetting the pulverized coal.

8. A process for the production of coke according to claim 5 wherein the feed coal is at least one kind of coal selected from the group consisting of non-coking coal, weak coking coal and soft coking coal.

9. A process for the production of coke according to claim 5 wherein gas generated by carbonization is used as the heating medium gas.

* * * * *